United States Patent [19]

Kopp

[11] Patent Number: 5,014,887

[45] Date of Patent: May 14, 1991

[54] VALVE FOR A CONTAINER FOR DISPENSING A PRESSURIZED FLUID

[75] Inventor: Volker Kopp, Esslingen, Switzerland

[73] Assignee: C. Ehrensperger AG, Erlenbach, Switzerland

[21] Appl. No.: 380,209

[22] Filed: Jul. 14, 1989

[30] Foreign Application Priority Data

Jul. 14, 1988 [CH] Switzerland ..... 2699/88

[51] Int. Cl.[5] ..... B65D 83/48

[52] U.S. Cl. ..... 222/402.1; 222/402.24; 222/501; 222/542; 251/354

[58] Field of Search ..... 222/402.1, 402.14, 402.15, 222/402.21, 402.22, 402.23, 402.24, 402.25, 501, 518, 542; 251/149 B, 349, 353, 354, 339

[56] References Cited

U.S. PATENT DOCUMENTS

| | | | |
|---|---|---|---|
| 2,729,368 | 1/1956 | Lapin et al. | 222/402.22 |
| 2,829,806 | 4/1958 | Tedaldi | 222/402.22 |
| 2,869,764 | 1/1959 | Collins | 222/402.23 |
| 2,975,944 | 3/1961 | Michel | 222/402.23 |
| 3,104,786 | 9/1963 | Sanchis | 222/542 X |
| 3,144,057 | 8/1964 | O'Donnell | 222/402.25 X |
| 3,176,889 | 4/1965 | Potapenko . | |
| 3,182,864 | 5/1965 | Ellis et al. | 222/402.25 |
| 3,228,413 | 1/1966 | Stevens, Jr. . | |
| 3,231,154 | 1/1966 | Johnston . | |
| 3,300,104 | 1/1967 | Burt | 222/542 X |
| 3,318,492 | 5/1967 | Haas | 222/402.22 X |
| 3,357,604 | 12/1967 | Barker | 222/402.23 |
| 3,759,427 | 9/1973 | Stanley et al. | 222/402.23 |
| 3,785,536 | 1/1974 | Graham | 251/354 X |
| 3,913,608 | 10/1975 | Johnston . | |
| 4,522,318 | 6/1985 | Del Bon . | |

FOREIGN PATENT DOCUMENTS

| | | | |
|---|---|---|---|
| 273307 | 6/1964 | Australia | 222/402.1 |

*Primary Examiner*—David H. Bollinger

*Attorney, Agent, or Firm*—Fay, Sharpe, Beall, Fagan, Minnich & McKee

[57] ABSTRACT

The valve includes a valve body formed onto a lid of a container, a closure member which is located in the valve body and a spiral spring which presses the closure member into the valve body so as to keep the valve closed. A first sealing section is formed on a section of the closure member and cooperates with a valve seat in the valve body. A second sealing section is formed on the valve body and cooperates with a part of a spray gun or similar device, into which the valve body section is inserted in order to prevent a leaking or fluid at that point. The valve does not need any sealing members made of elastomeric materials or rubber. In this way, deterioration of such sealing members, which is caused by the fluid and leads to loss of sealing capability, is avoided. Containers which are equipped with such valves can be stored in any arbitrary position.

20 Claims, 2 Drawing Sheets

3
15
9
24
25
23
6
2
10
7
12
14
11
1
16
17
18
13
22
5
8
4
20
21
19
20

VALVE FOR A CONTAINER FOR DISPENSING A PRESSURIZED FLUID

BACKGROUND OF THE INVENTION

1. Field of the Invention

The present invention relates to a valve for a container for dispensing a pressurized fluid, which container has a lid and which valve includes a valve body having a valve seat, a closure member to be brought into a sealing contact with the valve seat and means for holding the closure member at the valve body.

2. Description of the Prior Art

Such valves are commonly known and are mounted to the container. The container includes a lid. This lid which is a sheet metal stamping is shaped to have a central projection, which determines a coaxial opening.

The valve includes a valve body, which is mounted to the projection, a closure member, which is movably located in the valve body and may be operated from the front side of the lid, a sealing member which is located between the valve body and the closure member and an elastic body which urges the closure member against the sealing member.

The sealing member is made of an elastomeric material or rubber and is contacted by the fluid flowing therethrough. Because these materials do not resist all kinds of fluids and may deteriorate, it is possible that the valve begins to leak.

SUMMARY OF THE INVENTION

A general object of the present invention is to provide a valve without such sealing members and of which the sealing area is resistant against the fluid flowing therethrough.

A further object is to provide a valve having a valve body which comprises a plastic part formed at the inner side of the lid of the container and an extension projecting at the outer side of the lid of the container and intended to be inserted into a spraying device, and having a through bore which includes the valve seat at its inlet side, which closure member is a plastic body having at least one sealing section, is movable in the through bore and movable into a sealing contact with the valve seat, and which valve comprises at least one elastic member urging the closure member against the valve seat.

The advantages gained by the invention are substantially that containers which contain various kinds of fluids, e.g. a propellant gas and polyurethane, can be stored in any arbitrary position without decreasing the sealing capability and further that the valve has a minimum of individual structural members.

Specifically advantageous is an embodiment, according to which the closure member has a substantially cylindrical shape and in which the sealing section includes at least one disk-shaped section which projects substantially radially from the sealing member. The deformation of the disk-shaped sealing sections guarantees a safe seal when the valve is in its closed condition.

By using two sealing sections the sealing capability can be improved further.

When using such valves, for instance, together with a spraying device, it is advantageous when the projection has a substantially cylindrical shape and if the projection includes a sealing section which has at least one disk-shaped section, which section projects substantially radially from the extension such to seal the valve upon insertion thereof.

By means of this additional seal a leaking of fluid towards the outside of the valve can positively be prevented.

BRIEF DESCRIPTION OF THE DRAWING

The invention will be better understood and objects other than those set forth above will become apparent when consideration is given to the following detailed description thereof. Such description makes reference to the annexed drawing, in which.

DESCRIPTION OF THE PREFERRED EMBODIMENT

Figure 1:
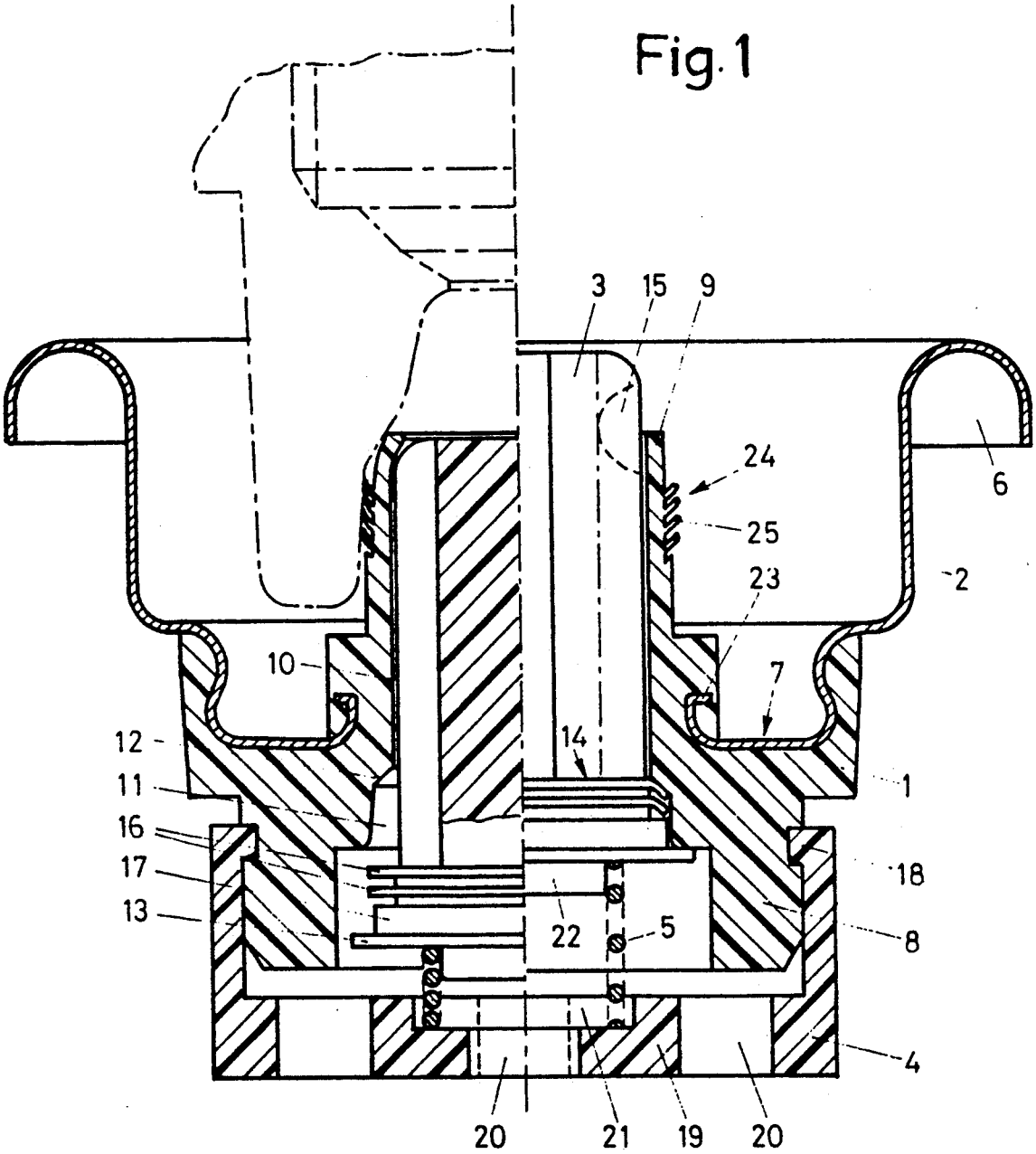
FIG. 1 illustrates a section through a preferred embodiment showing specifically at the right-hand side of the longitudinal center line the valve in its closed position and at the left-hand side the valve in its open position.

The valve includes a valve body which is formed at the inner side of a lid 2 of a container, includes a closure member 3 located in the valve body 1, a supporting member 4 mounted to the valve body 1 and a spiral spring 5 which is inserted between the closure member and the supporting member.

According to the illustration the lid 2 of the container is a hollow cylinder having at one face a pre-flanged section 6 intended for a mounting to an edge of a container and at the opposite face a second section 7 having a flared terminal annular projection 23 and which is formed onto the valve body 1. This flared terminal annular projection 23 secures an absolute gastight design at this area. The lid 2 of the container is a stamping and includes a central opening. The valve body 1 includes a section 8 which projects from the inner side of the lid 2 of the container and forms an inlet and includes further an extension 9 which extends through the opening in the direction towards the outer side of the lid 2 of the container and which forms the outlet.

The valve body 1 includes further a through bore 10 proceeding from mentioned outlet up to a section 11 including the valve seat, which valve seat is shaped as an inclined surface proceeding from mentioned through bore.

The closure member 3 has a cylinder-shaped body including a flange 13 at one end, a sealing section 14 located adjacent the flange 13 and four grooves 15 which originate at the sealing section 14 and extend up to the other end of the body. The grooves 15 have a semicircular shape.

The inventive sealing section 14 is formed by two disk-shaped sections 16 which extend radially from the body and an extension 17 which borders directly on the flange 13.

The supporting member 4 is shaped as a hood which may be placed onto the section 8. To this end the hood is provided at its edge with a collar 18 and the section 8 is provided with a groove, in which the collar is received. A plurality of holes 20 are provided in the bottom 19 of the hood. Furthermore, a recess 21 is arranged at the inner side of the hood, in which recess the spring 5 is centered.

On the other hand this spring 5 is held at a projection 22 of the closure member 3.

Adjacent the sealing section 14 the valve includes at the closure member 3 in accordance with the invention a second sealing section 24 which is formed at the extension 9 at the area of the outlet.

The second sealing section is formed by four disk-shaped sections 25. These sections 25 project obliquely from the extension 9 towards the outside and face towards the outlet.

In the closed condition of the valve, which condition is illustrated at the right-hand side of the longitudinal center line designed in the drawing, the valve is held closed substantially by the pressure prevailing in the (not illustrated) container. If the container is completely empty, the valve is held closed by the spring 5 for safety reasons only. From this, it can be derived that the closing of the valve caused by the spring 5 can be made by means of at least one elastic section provided at the extension.

The closure member 3 in the valve body 1 is urged by the pressure against the outlet side such that the disk-shaped sections 16 contact sealingly the valve seat, whereby the respective front section 16 is pressed against the seat 12 when two such adjacently located sections are present as is the case in the illustrated embodiment. The deforming of the disk-shaped sections 16 is caused in that the outer diameter of these sections is larger than the inner diameter of the section 11 in the valve body 1 of the inventive valve seat.

A further possibility of designing the inventive valve seat is to shape the section adjoining the valve seat 12 conically or cylindrically.

In the open condition of the valve, which condition is illustrated at the left-hand side of the figure, the closure member 3 of the valve is moved by a section of a spraying device or similar article illustrated with broken lines against the pressure in the container such that the contents of the container can flow out. At the same time the second sealing section 24 is brought to sealingly engage the section forming the opening of the valve such to prevent a leaking of fluid out of the container and into the lid 2. By means of this arrangement a soiling by means of a fluid, for instance, foamed polyurethane which is difficult to clean is positively avoided.

Figure 2:
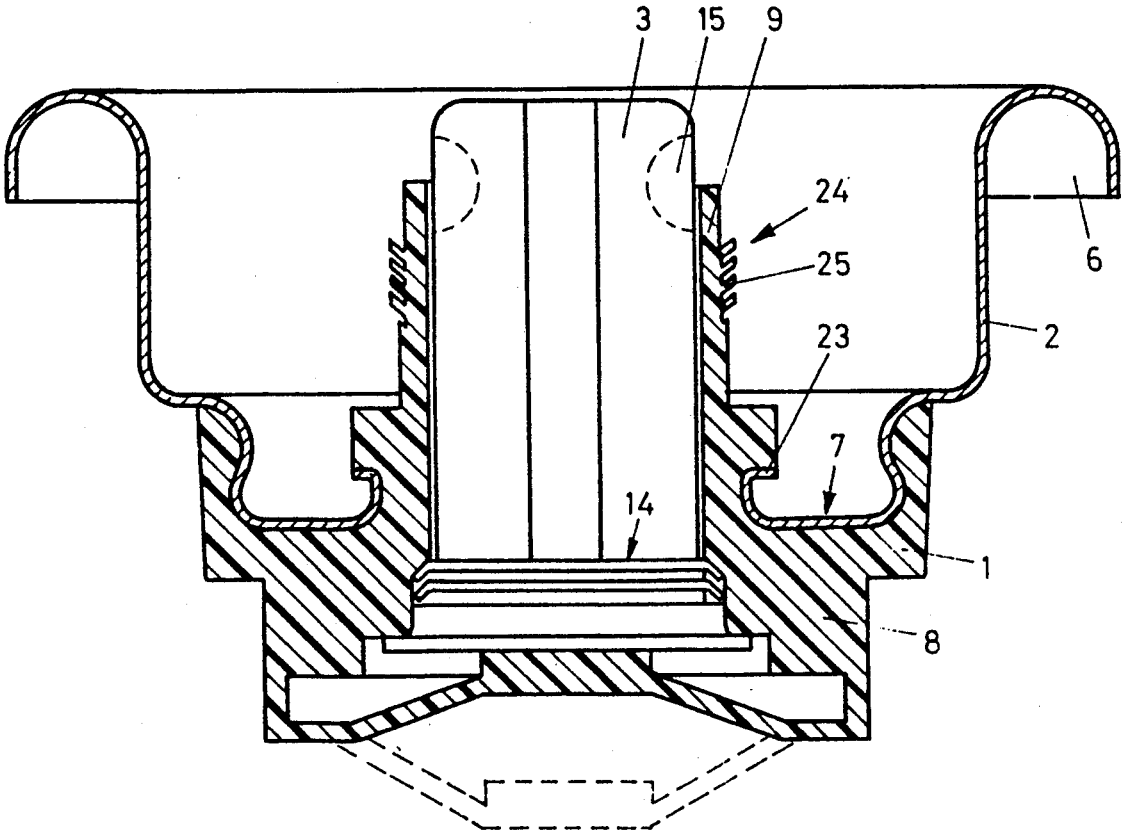
FIG. 2 is a sectional view of a right-hand side of a valve in a closed position according to illustrates an alternate embodiment of the present invention.

FIG. 2 illustrates an alternate embodiment of the present invention. In this embodiment, the spring 5 shown in FIG. 1 is replaced with an elastic member which is an integral section of the valve body formed at the inlet side thereof. If desired, a plurality of such elastic members can be provided.

While there is shown and described a present preferred embodiment of the invention, it is to be distinctly understood that the invention is not limited thereto, but may be otherwise variously embodied and practiced within the scope of the following claims.

I claim:

1. A valve for a container for dispensing a pressurized fluid, which container has a lid with an aperture extending therethrough, said aperture being defined by an inner edge of said lid, and which valve includes a valve body extending through said lid aperture and having a valve seat, a closure member to be brought into a sealing contact with the valve seat and means for holding the closure member to the valve body, said valve body comprising a plastic part that comprises a first section which extends to an inner side of the lid of the container and a second section projecting to an outer side of the lid of the container and wherein said inner edge comprising an outwardly flaring annular projection adjacent said aperture of said lid is embedded in said plastic part, wherein said second section is intended to be inserted into an associated spraying device, said plastic part further comprising a through bore which includes the valve seat at its inlet side, wherein said closure member comprises a plastic body having at least one sealing section, said closure member being movable in said through bore and movable into a sealing contact with said valve seat, and which valve further comprises at least one biasing member for urging said closure member against said valve seat.

2. The valve of claim 1, in which said closure member is substantially of a cylindrical shape, and in which said at least one sealing section is integral with said closure member and comprises at least one disk-shaped section projecting substantially radially from said closure member and adapted to be flexed to establish a sealing contact with said valve seat.

3. The valve of claim 1, in which said closure member comprises two adjacently arranged sealing sections.

4. The valve of claim 1, further comprising a hood secured to the inlet side of the valve body and in which said biasing member comprises a spiral spring located between said hood and said closure member.

5. The valve of claim 1, wherein said biasing member comprises an integral section of said valve body formed at the inlet side thereof.

6. The valve of claim 5, wherein a plurality of biasing members is provided.

7. The valve of claim 1, wherein said valve body second section projecting at the outer side of the lid of the container has a substantially cylindrical shape and wherein said second section includes a sealing section having at least one disk-shaped section projecting substantially radially from said second section in order to seal the valve against the associated spraying device upon an insertion thereof into the associated spraying device.

8. The valve of claim 7, wherein said sealing section comprises two adjacently located sections.

9. The valve of claim 1, wherein said outwardly flared projection forming a ring extending in a plane substantially normal relative to said through bore.

10. A valve construction for a container dispensing a pressurized fluid, comprising:

a lid mounted on the container and having an aperture extending therethrough, said aperture being defined by an inner peripheral wall of said lid;

a tubular valve body extending through said lid, said valve body comprising:

a first section extending into the container, a second section extending out of the container, a through bore which includes a valve seat on its inlet side, and an outer periphery into which an outwardly flaring annular projection of said inner peripheral wall of said lid is embedded;

a valve member adapted for reciprocation in said valve body through bore; and, a resilient member for biasing said valve member against said valve seat of said valve body.

11. The valve construction of claim 10 wherein said valve member further comprises a first seal means, which is of one piece with said valve member, for sealing said valve member against said valve seat.

12. The valve construction of claim 10 wherein said valve body further comprises a second seal means located on an outer periphery of said valve body second section for sealing against an associated spraying device into which said second section is adapted to extend.

13. The valve construction of claim 10 further comprising a hook-like supporting member which is secured to said valve body first section, wherein said resilient member comprises a spring which extends between said supporting member and said valve member.

14. A valve construction for a container dispensing a pressurized fluid, comprising:

a lid mounted on the container and having an aperture extending therethrough, said aperture being defined by an inner peripheral wall of said lid;

a tubular valve body extending through said lid, said valve body comprising:

a first section extending into the container, a second section extending out of the container, a through bore which includes a valve seat on its inlet side, and an outer periphery into which said inner peripheral wall of said lid is embedded;

a valve member adapted for reciprocation in said valve body through bore;

a first seal means, which is of one piece with said valve member, for sealing said valve member against said valve seat, wherein said valve member comprises a plastic material and wherein said first seal means comprises at least one resilient lip extending circumferentially around a periphery of said valve member; and, a resilient member for biasing said valve member against said valve seat of said valve body.

15. The valve construction of claim 14 wherein said first seal means comprises two resilient lips which are spaced from each other.

16. The valve construction of claim 14 wherein said valve member further comprises:

a flange located on one end of said valve member in spaced relationship to said seal means, said flange being of a larger diameter than said at least one resilient lip; and, an extension section which is located between said flange and said at least one resilient lip.

17. A valve assembly for a container dispensing a pressurized fluid, comprising:

a lid adapted to constitute a closure for the container, said lid having a substantially centrally located aperture;

a one-piece valve body which extends through said lid aperture such that an inner edge of said lid is embedded in an outer side wall of said valve body, said valve body comprising:

a longitudinally extending through bore, a valve seal located on an inlet side of said through bore, a first valve body section located within said lid, and a second valve body section extending out of said lid and intended to be inserted into an associated spraying device;

a valve member mounted for reciprocation in said valve body through bore;

a first seal means for sealing between said valve member and said valve body valve seat wherein said valve member comprises a plastic material and wherein said first seal means comprises at least one resilient lip which is of one-piece with and extends circumferentially around a periphery of said valve member; and, a biasing means for biasing said valve member against said valve seat.

18. The valve construction of claim 17 further comprising a hood-like supporting member which is secured to said valve body first section, wherein said basing means comprises a spring which extends between said supporting member and said valve member.

19. The valve construction of claim 17 wherein said valve body further comprises a second seal means located on an outer periphery of said valve body second section for sealing against the associated spraying device.

20. The valve construction of claim 19 wherein said second seal means comprises at least one resilient lip which is of one-piece with an extends circumferentially around said outer periphery of said valve body second section.

* * * * *